US010786409B2

(12) United States Patent
Choudhury et al.

(10) Patent No.: US 10,786,409 B2
(45) Date of Patent: Sep. 29, 2020

(54) GAIT BELT

(71) Applicant: Concepto LLC, Lebanon, OH (US)

(72) Inventors: Sambhu Choudhury, Cincinnati, OH (US); Sean Lynch, Cincinnati, OH (US); Arturo David Sanchez, Cincinnati, OH (US)

(73) Assignee: Concepto LLC, Lebanon, OH (US)

( * ) Notice: Subject to any disclaimer, the term of this patent is extended or adjusted under 35 U.S.C. 154(b) by 0 days.

(21) Appl. No.: 16/109,286

(22) Filed: Aug. 22, 2018

(65) Prior Publication Data

US 2018/0360682 A1 Dec. 20, 2018

Related U.S. Application Data

(63) Continuation of application No. 14/801,454, filed on Jul. 16, 2015, now abandoned.

(60) Provisional application No. 62/026,397, filed on Jul. 18, 2014.

(51) Int. Cl.

| | |
|---|---|
| ***A61G 7/10*** | (2006.01) |
| ***A41F 9/00*** | (2006.01) |
| ***A62B 35/00*** | (2006.01) |

(52) U.S. Cl.

CPC ..... *A61G 7/1023* (2013.01); *A41F 9/005* (2013.01); *A61G 7/1038* (2013.01); *A61G 7/1051* (2013.01); *A62B 35/00* (2013.01)

(58) Field of Classification Search

CPC .. A61G 7/1013; A61G 7/1023; A61G 7/1038; A61G 7/1051; A61G 7/109; A61G 7/1088; A41F 9/005; A62B 35/00; A47D 13/046; A47D 13/086

See application file for complete search history.

(56) References Cited

U.S. PATENT DOCUMENTS 1,310,958 A * 7/1919 O'Connor ..... B60R 22/105 297/484
2,212,746 A * 8/1940 Nunn ..... A47D 13/086 119/770
3,458,878 A * 8/1969 Combs ..... A61G 7/1023 5/81.1 T
4,667,624 A * 5/1987 Smith ..... A01K 27/00 119/770
4,759,311 A * 7/1988 Boyle ..... A01K 27/00 119/857
4,793,008 A * 12/1988 Johansson ..... A61G 7/103 5/81.1 T
4,860,560 A * 8/1989 Lundelius ..... A61F 5/37 70/16
5,253,657 A * 10/1993 Butterfield ..... A61G 7/1023 128/845

(Continued)

*Primary Examiner* — David R Hare
(74) *Attorney, Agent, or Firm* — Jenei LLC

(57) ABSTRACT

A support belt assists caretaker in moving an ambulatory-impaired person. A strap has a plurality of attachment fixtures such as grommets that are longitudinally spaced and has a buckle for engaging the strap around a torso of an individual. The connector is engageable between a selected two of the attachment fixtures to draw one portion of the strap to closely encircle the ambulatory-impaired person and to form another portion of the strap into a grasping loop. A second support belt can be attached to the strap by two or more belt connector in order to double the portion of the torso encircled or to support buttocks or thigh of the ambulatory-impaired person.

6 Claims, 10 Drawing Sheets

(56) References Cited

U.S. PATENT DOCUMENTS 5,397,171 A * 3/1995 Leach ..... A61F 5/3784 128/875
5,688,011 A * 11/1997 Gulley ..... B66C 1/105 294/74
5,718,189 A * 2/1998 Blake ..... A01K 27/00 119/770
5,896,859 A * 4/1999 Carroll ..... A61G 7/1023 128/845
6,058,513 A * 5/2000 Simmons ..... A41F 9/005 2/312
6,073,280 A * 6/2000 Farnum ..... A61F 5/03 128/876
6,122,778 A * 9/2000 Cohen ..... A62B 35/0006 182/3
6,311,346 B1 * 11/2001 Goldman ..... A61F 5/37 128/876
6,671,899 B1 * 1/2004 Oja ..... A61G 7/1023 5/81.1 T
6,715,167 B2 * 4/2004 Wake ..... A61G 7/1023 5/81.1 T
6,908,131 B2 * 6/2005 Main ..... A61G 7/1023 294/150
7,103,943 B2 * 9/2006 Lambert ..... A01K 27/00 119/792
7,341,025 B1 * 3/2008 Streeter ..... A47D 13/046 119/770
7,963,365 B2 * 6/2011 Grilliot ..... A62B 5/00 182/3
8,321,972 B1 * 12/2012 Vetter ..... A61G 7/1023 5/81.1 R
2004/0025250 A1 * 2/2004 Bezalel ..... A61G 7/1023 5/81.1 R
2009/0178194 A1 * 7/2009 Story ..... A61G 7/1023 5/81.1 R
2015/0021118 A1 * 1/2015 Doty ..... A61G 7/1023 182/3

* cited by examiner

GAIT BELT

RELATED APPLICATIONS

The present application for patent is a continuation of patent application Ser. No. 14/801,454 entitled "GAIT BELT" filed Jul. 16, 2015, and claiming priority to application claims the benefit of U.S. Provisional Application No. 62/026,397, entitled "GAIT BELT" and filed Jul. 18, 2014. The entire disclosure of which is hereby incorporated by reference for all purposes.

BACKGROUND OF THE INVENTION

Field of the Invention

The field of art disclosed herein generally pertains to devices for moving or assisting ambulation-impaired individuals, and more particularly, to a device that is configurable and adjustable to serve as a belt, harness and straps for assisting individuals in being lifted and in walking.

Description of the Related Art

In medical or assistive care situations, persons that are restricted or limited in movement or ambulation due to age, illness or injury pose difficulties for caretakers. Such caretakers may find it challenging to move or assist such persons without injuring themselves or the ambulatory-impaired person. A transfer belt is a device that is used to move such persons. However, generally-known transfer belts can have utility limited to specific assistance scenarios and not be particularly suited to a range of situations.

SUMMARY OF THE INVENTION

In one aspect, the present disclosure provides a support belt for caretaker assisting an ambulatory-impaired person. The support belt includes a belt connector and a strap having a plurality of attachment fixtures that are longitudinally spaced and a buckle for engaging the strap around a torso of an individual. The belt connector is engageable between a selected two of the attachment fixtures to draw one portion of the strap to closely encircle the ambulatory-impaired person and to form another portion of the strap into a grasping loop.

In another aspect, the present disclosure provides a support belt system for caretaker assisting of an ambulatory-impaired person. The support belt system includes a patient support harness attachable to a torso of a patient. A caregiver harness is attachable to a torso of a caregiver. A strap is attached at one end and selectably connected at another end between the patient harness and the caregiver harness.

In an additional aspect, the present disclosure provides a support belt for caretaker assisting of an ambulatory-impaired person that is seated. In one embodiment, the support belt includes a grasping strap having left and right gripping ends that is sized to encircle a torso of a seated patient. A torso strap is lengthwise attached to the grasping strap and comprises an adjustable strap attachment for fastening around a front of the torso of the patient. A buttock strap is attachable between each lateral side of a combination of the grasping strap and torso strap for placement under buttocks or thighs of the seated patient.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE FIGURES

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which.

DETAILED DESCRIPTION

Turning now to the Drawings, the detailed description set forth below in connection with the appended drawings is intended as a description of various configurations and is not intended to represent the only configurations in which the concepts described herein may be practiced. The detailed description includes specific details for the purpose of providing a thorough understanding of various concepts with like numerals denote like components throughout the several views. However, it will be apparent to those skilled in the art that these concepts may be practiced without these specific details. In some instances, well known structures and components are shown in block diagram form in order to avoid obscuring such concepts.

Figure 1:
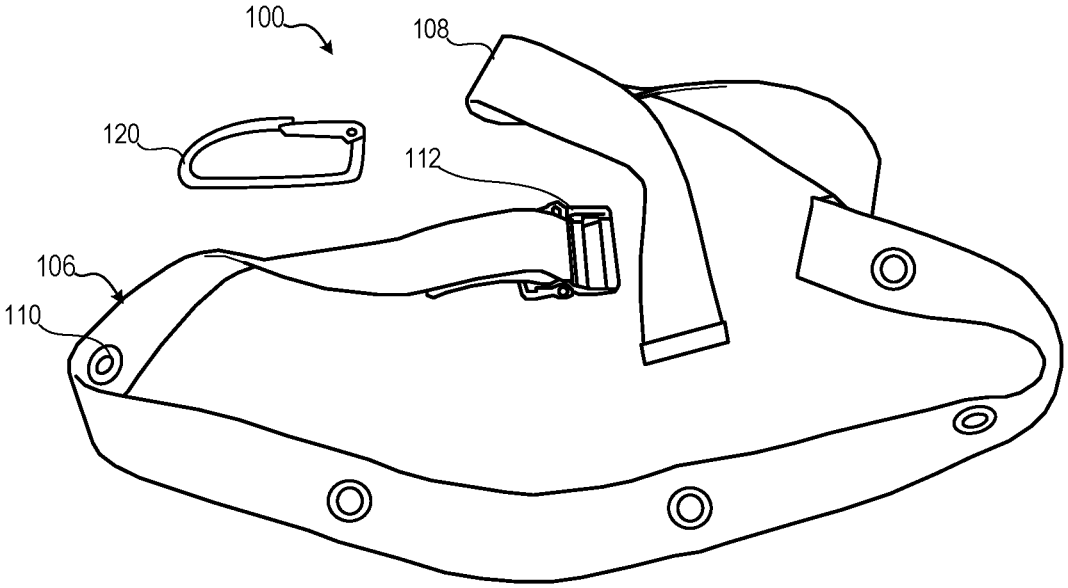
FIG. 1 illustrates a perspective, disassembled view of a support apparatus that includes a gait belt and belt connector, according to one embodiment.
Figure 2:
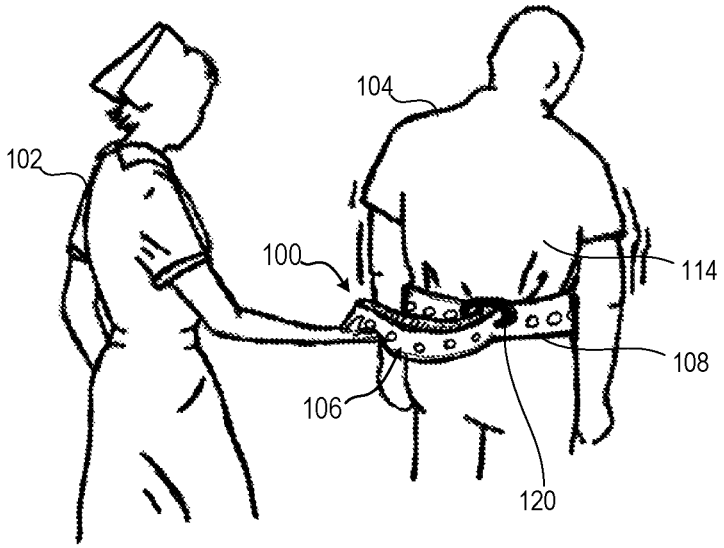
FIG. 2 illustrates a perspective, assembled view of the support apparatus of FIG. 1 configured with a gripping handle.
Figure 3:
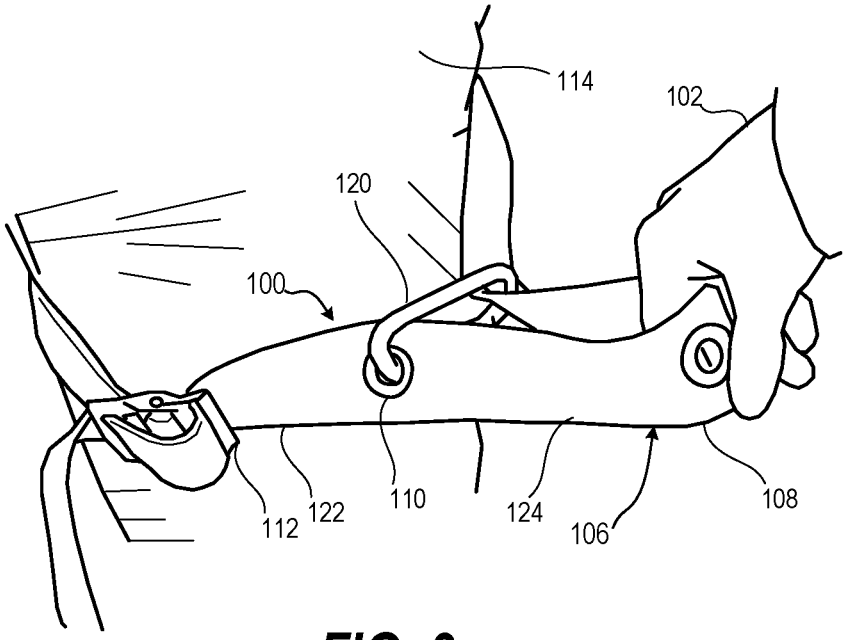
FIG. 3 illustrates a detail view of the support apparatus of FIG. 2.

With initial reference to FIGS. 1-3, a support belt assembly 100 is provided for a caretaker 102 to assist an ambulatory-impaired person 104. Each gait belt 106 of the support belt assembly 100 is formed from a strap 108 having a plurality of attachment fixtures, depicted as grommets 110, that are longitudinally spaced. A buckle 112 can engage the strap 108 around a torso 114 of an individual such as the ambulatory-impaired person 104. Examples of the buckle 112 include cam buckles, ratchet buckles, double D-ring straps, side release buckles, strap adjusters, and 3-bar slide buckles. The strap 108 can for example be a woven fabric belt such as flat nylon, tubular nylon, polypropylene, polyester, ribbon seat belt, cotton, etc.

With particular reference to FIGS. 2-3, the support apparatus 100 is modular, allowing adjustment and configuration to a range of uses and support. For instance, the gait belt 106 can be formed into handles. in particular, a first gait belt 106 of the exemplary support belt assembly 100 of FIG. 2 can be used with a belt connector 120, depicted as a carabiner. Examples of other belt connectors 120 include loops, hooks or chains. The belt connector 120 is engageable between a selected two of the attachment fixtures (grommets 110) to draw one encircling portion 122 of the strap 108 to closely encompass the ambulatory-impaired person 104 and to form another portion of the strap 108 into a grasping loop 124.

By contrast, a generally known belt can often become displaced from a patient's waist during the transfer process, thereby potentially injuring the patient. A patient with a rib, abdominal or chest injury/surgery cannot be easily manipulated with the belt. Standard belts are generally without handles making it difficult to transfer or move obese or even thin but muscular patients. The helper has to find a secure hold on the belt in order to accomplish a safe and steady transfer of the patient. Although the current gait belts are usually long and adjustable for multiple circumferences, usually they are usually only used around the waist and often are not able to be used functionally for every person in the same way.

Patients that have fallen on the floor are difficult to move as well. With a belt in place, lifting this patient can be done but requires tight control of a belt that is approximated to the patient. If several people are required to move or lift the patient, having several individuals grab the same gait belt becomes incrementally more difficult. Patients with an injured limb are also difficult to control with a single gait belt. Often the belt pulls up towards the axilla as it is being pulled taut. If there is a shoulder injury then the belt can create additional injury as it is being utilized.

Figure 4:
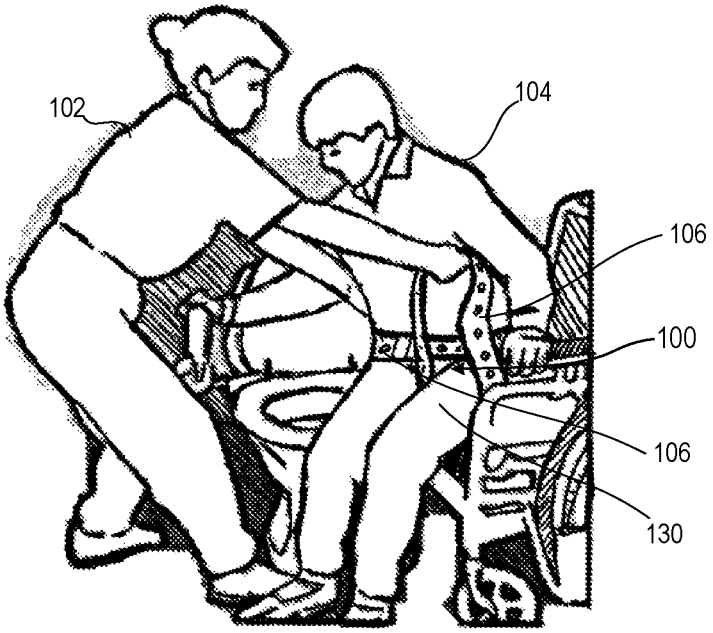
FIG. 4 illustrates a perspective view of an example support apparatus including two gait belts to support lifting an ambulatory-impaired person, according to one embodiment.
Figure 5:
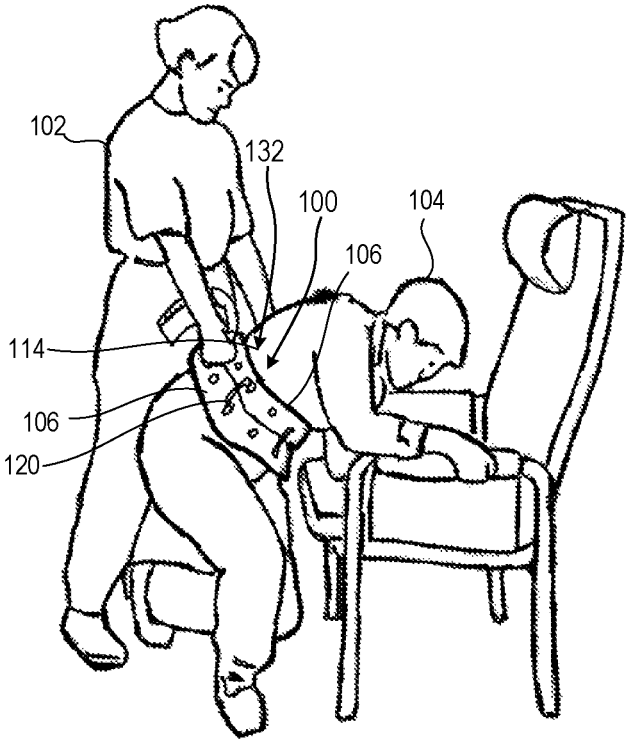
FIG. 5 illustrates a perspective view of another example support apparatus including two gait belts configured into a double-wide gait belt, according to at least one embodiment method.

With reference to FIGS. 4-5, example support apparatuses 100 can include additional gait belts 106 that can enable a full harness, or attachments to healthcare straps to allow for a lifting platform. With particular reference to FIG. 4, a second gait belt 106 can encircle a pelvic or thigh region 130 of the ambulatory-impaired person 104 to provide better distribution of weight than achievable with one gait belt 106 around the torso 114. Similarly, in FIG. 5, the second gait belt 106 is attached in parallel to the first gait belt 106 creating a double wide gait belt 132 that can distribute loads to the torso 114, such as avoiding undue pressure to certain ribs. It should be appreciated that a patient can be lifted and adjusted with support of the gait belt 106. The support apparatus 100 formed there with provides a transfer apparatus that can ensure correct and proper positioning and can be adjusted around a patient's waist throughout the entire transfer process.

Figure 6:
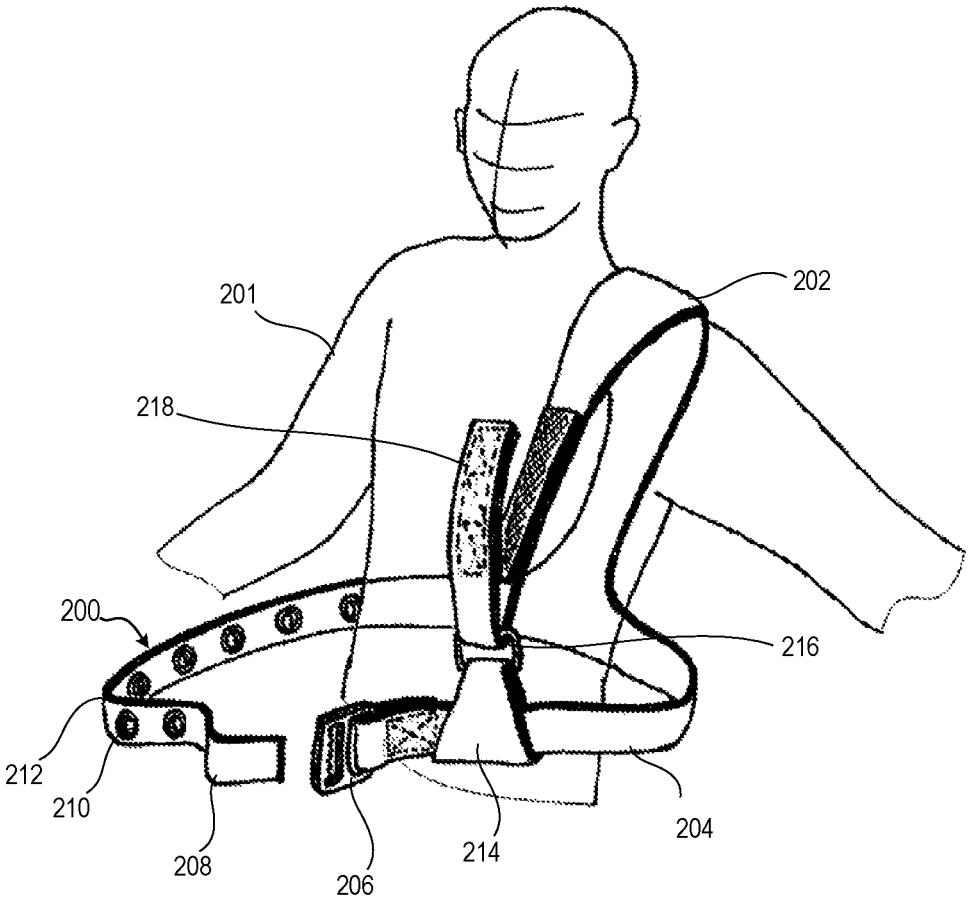
FIG. 6 illustrates a perspective view of a caregiver support harness, according to one embodiment.
Figure 7:
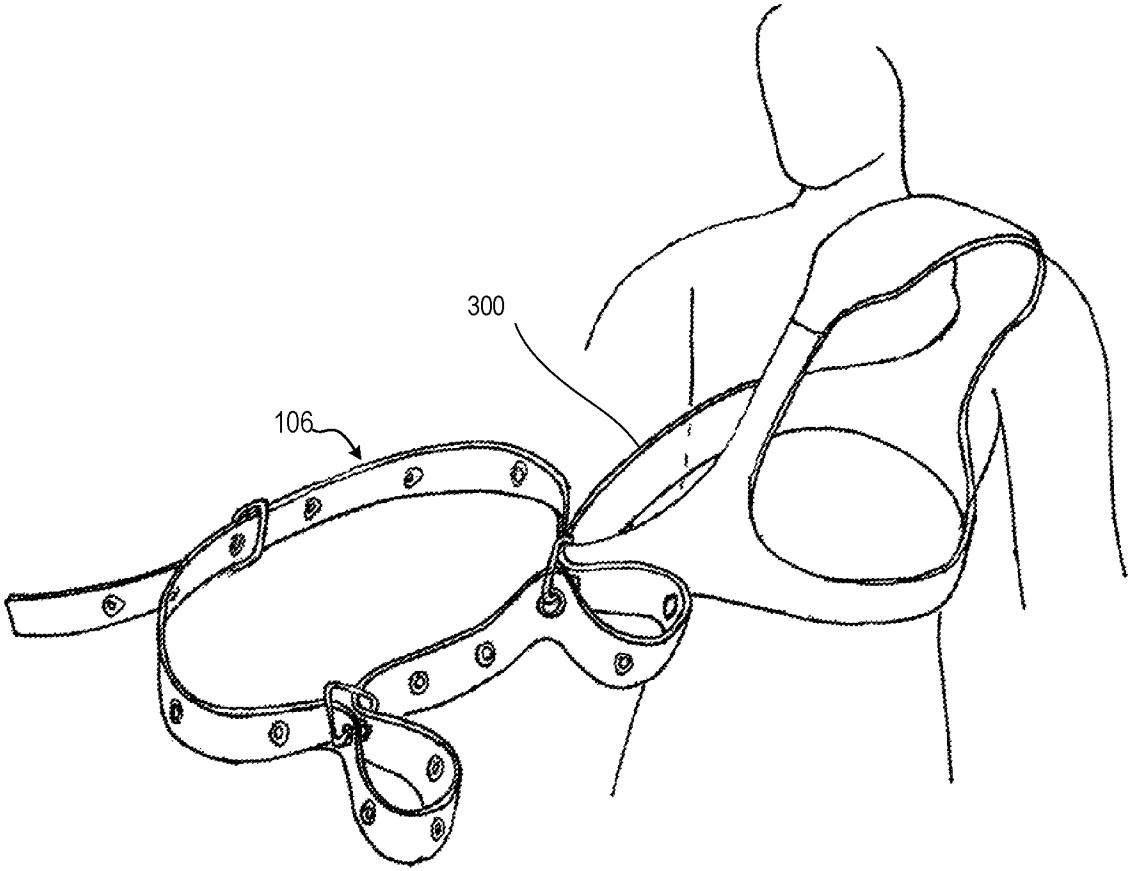
FIG. 7 illustrates a perspective view of a caregiver support harness attached to an adjustable gate belt and connectors, according to one embodiment.

FIG. 6 illustrates a caregiver support harness 200 for a caregiver 201 that has an adjustable height shoulder strap 202 that is fixedly attached on a back side and slidably received on a front side to an abdominal belt 204 according to one embodiment. One end of the abdominal belt 204 includes a strap buckle 206 and another end of the abdominal belt 204 is a strap 208 with grommets 210 for serving as an integral gait belt 212. Height adjustment can be provided by a slidable belt loop 214 that receives the abdominal belt 204 at one end and a slide ring 216 on the other. A velcroed end 218 of the adjustable shoulder strap 202 can be adjusted for length within the slide ring 216. FIG. 7 illustrates a caregiver support harness 300 attached to an adjustable gate belt 106, according to one embodiment.

Figure 8:
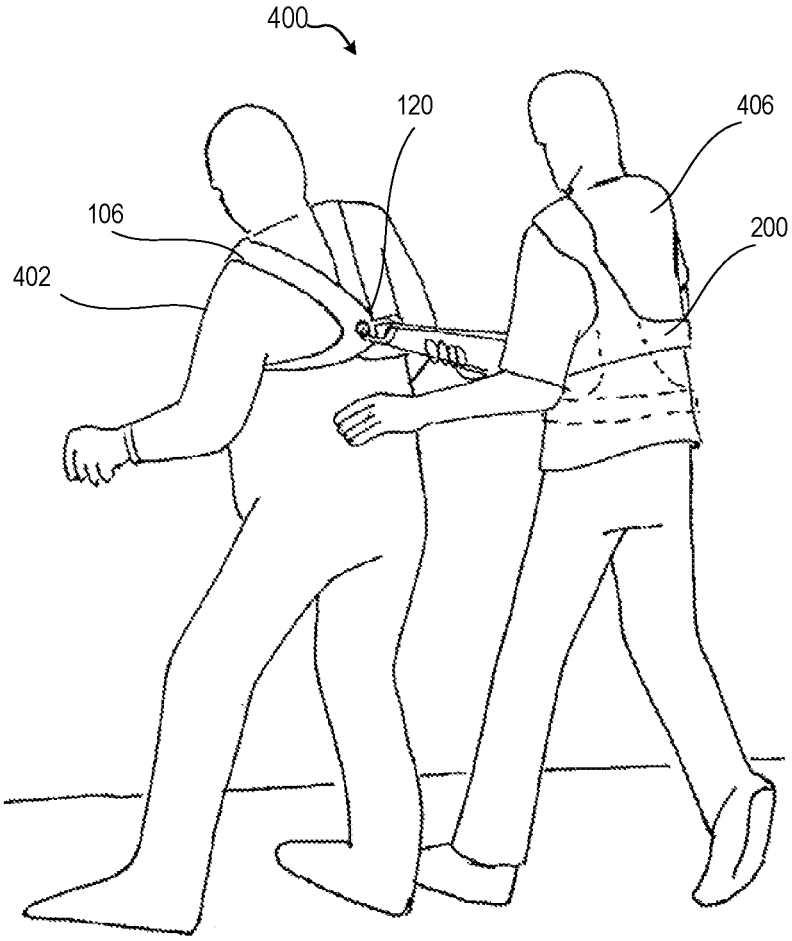
FIG. 8 illustrates a perspective view of a patient wearing an adjustable gate belt connected as an upper torso harness that is connected to an adjustable height caregiver support harness, according to one embodiment.

FIG. 8 illustrates a gait belt system 400 wherein a patient 402 is wearing a gait belt arranged in a double over the shoulder arrangement connected between the shoulder blades with a connector 120 that is also attached to the caregiver support harness 200 worn by a caregiver 406 that has the adjustable height shoulder strap 202, according to one embodiment.

Figure 9:
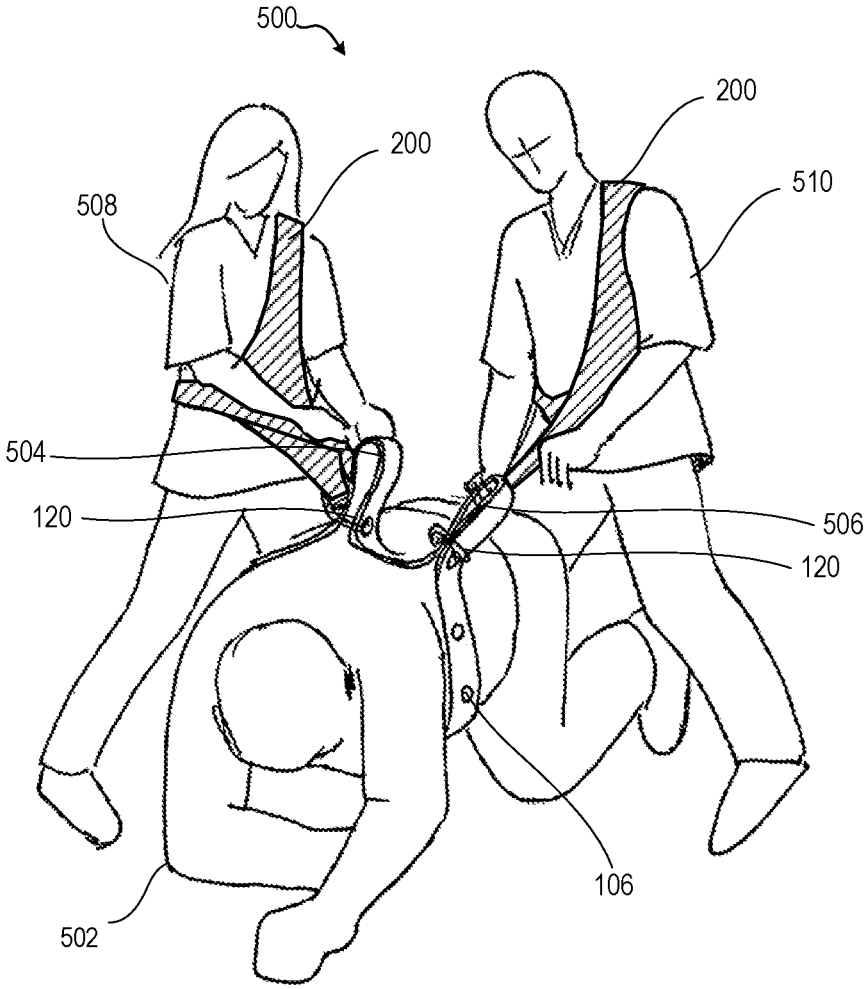
FIG. 9 illustrates a perspective view of a patient wearing an adjustable gate belt wrapped around an abdomen of a patient with connectors forming two rearward connecting loops that are attached to respective caregiver support harnesses, according to one embodiment.

FIG. 9 illustrates a gait belt system 500 perspective view of a patient 502 wearing an adjustable gate belt 106 wrapped around an abdomen of the patient 502 with connectors 120 forming two rearward connecting loops 504, 506 that are attached to respective caregiver support harnesses 200 worn by caregivers 508, 510, according to one embodiment.

Figure 10:
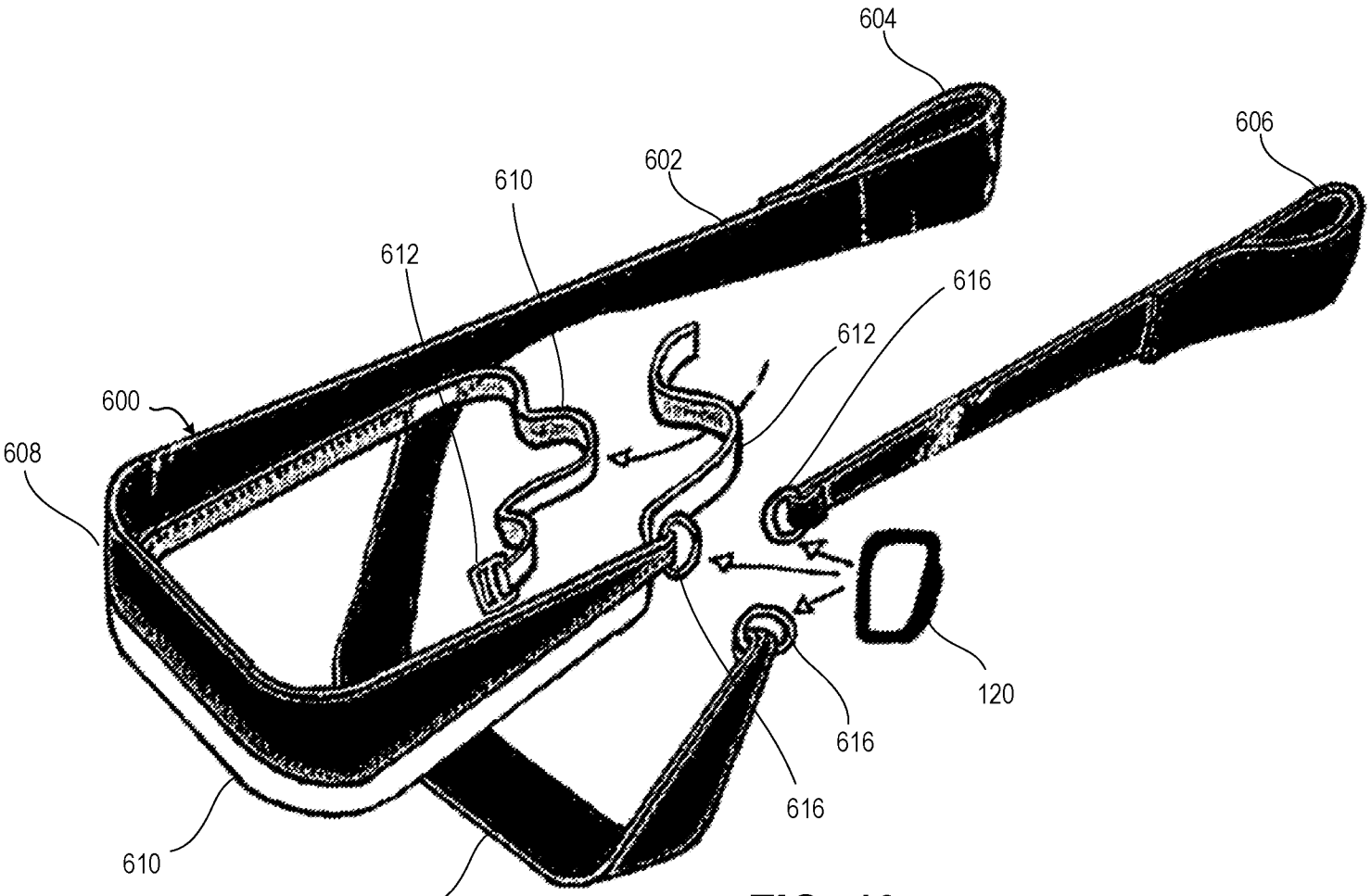
FIG. 10 illustrates a perspective view of another example patient support harness for attaching to a seated patient, according to one embodiment.

FIG. 10 illustrates another example patient support harness 600 for attaching to a seated patient, according to one embodiment. A grasping strap 602 with left and right gripping ends 604, 606 includes a wide strap 608 is sized to encircle a torso of a seated patient. A torso strap 610 is lengthwise attached to the grasping strap 602 and includes an adjustable strap attachment 612 for fastening around a front of the torso of the seated patient. A buttock strap 614 is attachable between each lateral side of a combination of the grapsing strap 602 and torso strap 610 for placement under buttocks or thighs of the seated patient. In an exemplary embodiment, one side of the buttock strap 614 is permanently attached at one side to the wide strap 608 and has another end terminated in an attachment loop 616. The right gripping end 606 is disconnected from the wide strap 608 with both having an attachment loop 616. All three attachment loops 616 are selectively attached to one another by a connector 120 after encircling the patient.

Figure 11:
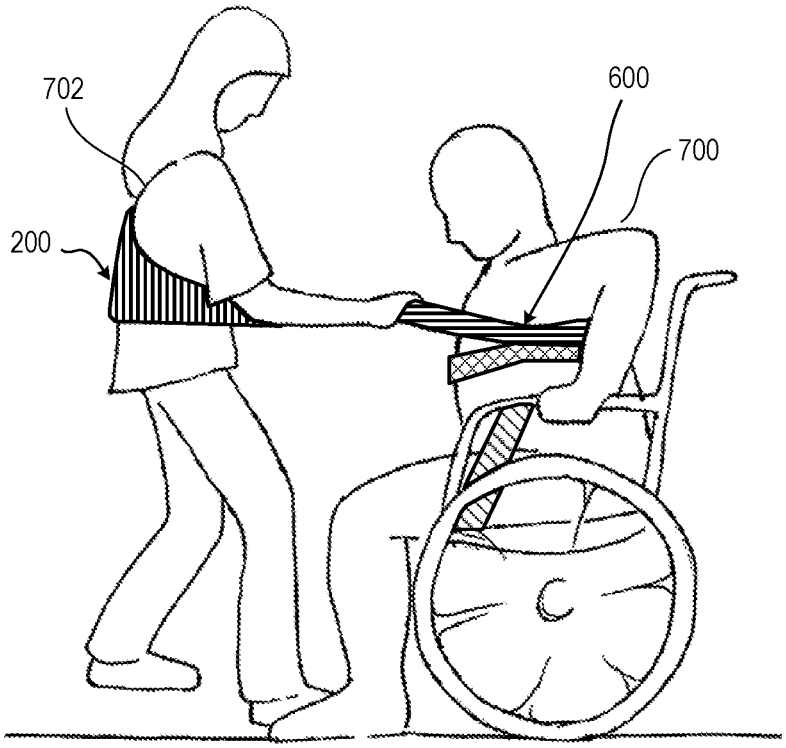
FIG. 11 illustrates a side view of a patient wearing the example patient support harness of FIG. 10 being assisted by a caregiver that is wearing a caregiver support harness, according to one embodiment.

FIG. 11 illustrates a patient 700 wearing the example patient support harness 600 being assisted by a caregiver 702 that is wearing a caregiver support harness 200, according to one embodiment.

Figure 12:
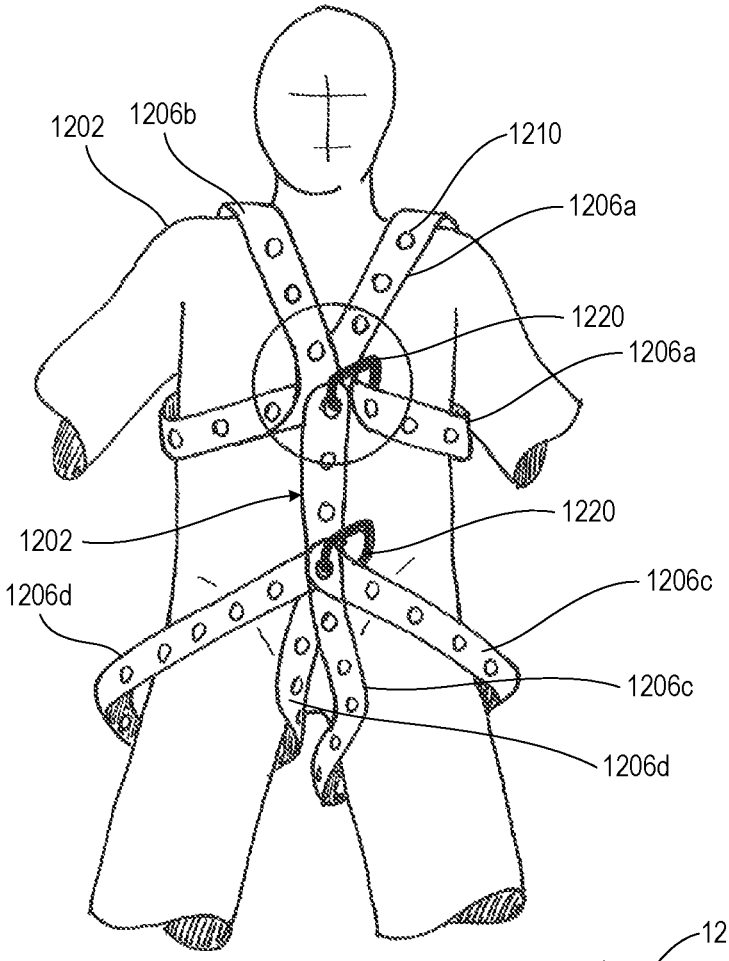
FIG. 12 illustrates a front view of a patient wearing an example patient support harness for full torso support, according to one embodiment.
Figure 13:
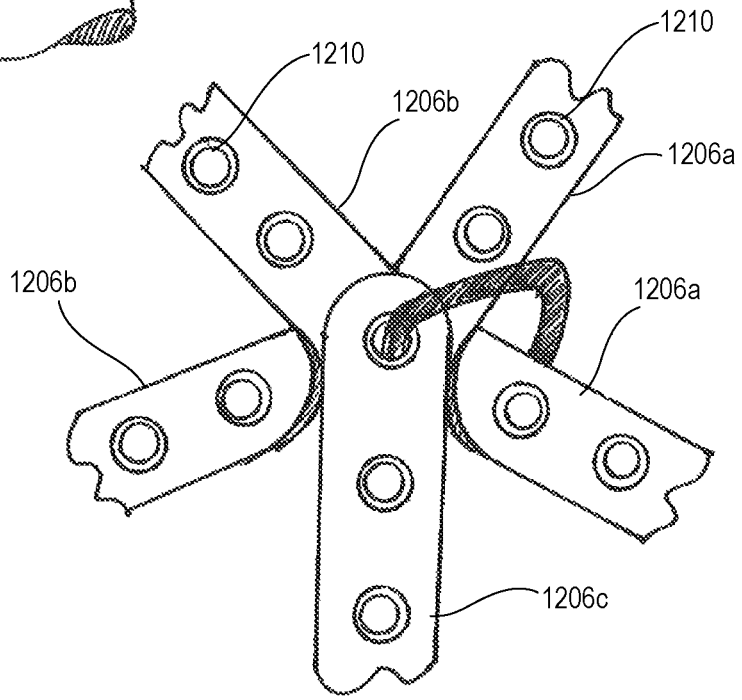
FIG. 13 illustrates a front detail view of the example patient support harness of FIG. 12, according to one embodiment.

FIGS. 12-13 illustrate a patient 1202 wearing the example patient support harness 1200, according to one embodiment. Grommets. A first gait belt 1206*a* encircles a left shoulder, a second gait belt 1206*b* encircles a right shoulder, a third gait belt 1206*c* encircles a left hip, and a fourth gait belt 1206*d* encircles a right hip. Attachment fixtures of the gait belts 1206*a*-1206*d*, depicted as grommets 1210, can be spaced 5" apart. Belt connectors 1220, depicted as a carabiners, attach the gait belts 1206*a*-1206*d* together in the front.

All publications, patents and patent applications cited herein, whether supra or infra, are hereby incorporated by reference in their entirety to the same extent as if each individual publication, patent or patent application was specifically and individually indicated as incorporated by reference. It should be appreciated that any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as explicitly set forth herein supersedes any conflicting material incorporated herein by reference. Any material, or portion thereof, that is said to be incorporated by reference herein, but which conflicts with existing definitions, statements, or other disclosure material set forth herein, will only be incorporated to the extent that no conflict arises between that incorporated material and the existing disclosure material.

It must be noted that, as used in this specification and the appended claims, the singular forms "a," "an" and "the" include plural referents unless the content clearly dictates otherwise. Thus, for example, reference to a "colorant agent" includes two or more such agents.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

As will be appreciated by one having ordinary skill in the art, the methods and compositions of the invention substantially reduce or eliminate the disadvantages and drawbacks associated with prior art methods and compositions.

It should be noted that, when employed in the present disclosure, the terms "comprises," "comprising," and other derivatives from the root term "comprise" are intended to be open-ended terms that specify the presence of any stated features, elements, integers, steps, or components, and are not intended to preclude the presence or addition of one or more other features, elements, integers, steps, components, or groups thereof.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

While it is apparent that the illustrative embodiments of the invention herein disclosed fulfill the objectives stated above, it will be appreciated that numerous modifications and other embodiments may be devised by one of ordinary skill in the art. Accordingly, it will be understood that the appended claims are intended to cover all such modifications and embodiments, which come within the spirit and scope of the present invention.

What is claimed is:

1. A method assisting an ambulatory-impaired person, the method comprising:

positioning a strap of a support belt around a torso of an ambulatory-impaired person;

engaging a buckle of the strap to loosely encompass the torso;

attaching a first belt connector between a selected pair of attachment fixtures that are longitudinally spaced about the strap to draw the selected pair of attachment fixtures into proximity, creating a first adjusted loop around the torso and a first grasping loop from the strap of the support belt;

attaching a second belt connector between another selected pair of attachment fixtures that are longitudinally spaced about the strap to draw the other selected pair of attachment fixtures into proximity, creating: (i) a second adjusted loop around the torso that is tighter than the first adjusted loop; and (ii) a second grasping loop; and pulling on both the first and second grasping loops to assist the ambulatory-impaired person in a selected one of: (i) changing from a seated position to a standing position; and (ii) steadying a walking gait.

2. The method of claim 1, further comprising:

attaching a caregiver support harness around a torso of a caregiver;

attaching the caregiver support harness to the first grasping loop; and pulling on the first grasping loop by movement of the torso of the caregiver via the caregiver support harness.

3. The method of claim 1, further comprising:

attaching a first caregiver support harness around a torso of a first caregiver;

attaching the first caregiver support harness to the first grasping loop;

attaching a second caregiver support harness around a torso of a second caregiver;

attaching the second caregiver support harness to the second grasping loop;

pulling on the first grasping loop by movement of the torso of the first caregiver via the first caregiver support harness; and pulling on the second grasping loop by movement of the torso of the second caregiver via the second caregiver support harness.

4. The method of claim 1, wherein each of the attachment fixtures comprise a grommet.

5. The method of claim 1, wherein the first belt connector comprises one or more devices selected from the group consisting of a carabiners, loops, hooks and chains.

6. The method of claim 1, further comprising attaching a buttock strap between two attachment features of the strap and under buttocks or thighs of a seated ambulatory-impaired person.

* * * * *